US006357942B1

(12) United States Patent
Adkins et al.

(10) Patent No.: US 6,357,942 B1
(45) Date of Patent: Mar. 19, 2002

(54) METHOD FOR REDUCING CYCLIC PRINT ERRORS

(75) Inventors: Christopher Alan Adkins; Michael Anthony Marra, III; David Michael Cseledy, all of Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 09/649,405

(22) Filed: Aug. 24, 2000

(51) Int. Cl.[7] ..... B41J 21/17

(52) U.S. Cl. ..... 400/703; 400/70; 101/486; 358/504; 358/505; 347/19; 347/37

(58) Field of Search ..... 400/103, 104, 400/70; 101/486; 358/504, 505, 509, 11, 506; 347/19, 37; 359/223; 356/499

(56) References Cited

U.S. PATENT DOCUMENTS 4,353,298 A * 10/1982 Baker et al. ..... 400/70
4,353,653 A * 10/1982 Zimmerman ..... 400/70
4,449,052 A 5/1984 Krieg
4,452,136 A * 6/1984 Boynton et al. ..... 400/70
4,636,043 A * 1/1987 Bellar ..... 359/223
4,855,909 A 8/1989 Vincent et al.
4,939,674 A 7/1990 Price et al.
5,117,374 A * 5/1992 Goetz ..... 347/37
5,363,217 A * 11/1994 Ketghtley ..... 358/506
5,410,338 A 4/1995 Jadrich et al.
5,564,841 A 10/1996 Austin et al.
5,598,201 A 1/1997 Stodder et al.
5,621,864 A 4/1997 Benade et al.
5,676,473 A 10/1997 Wright, IV et al.
5,681,120 A 10/1997 Ackley
5,767,498 A 6/1998 Heske, III et al.
5,835,615 A 11/1998 Lubow et al.
5,853,252 A 12/1998 Wright, IV et al.
5,857,784 A 1/1999 Allen
5,857,789 A 1/1999 Day et al.
5,909,283 A * 1/1999 Eseim ..... 356/499
5,871,288 A 2/1999 Ryan, Jr. et al.
5,890,817 A 4/1999 Ackley
5,937,145 A 8/1999 Garboden et al.
5,941,649 A 8/1999 Hansel et al.
5,943,073 A 8/1999 Otsuka et al.
5,991,055 A * 11/1999 Haselby et al. ..... 358/509
6,137,592 A * 10/2000 Arquilevich et al. ..... 358/1.8

* cited by examiner

*Primary Examiner*—Eugene Eickholt
(74) *Attorney, Agent, or Firm*—Douglas E. Erikson, Esq.

(57) ABSTRACT

A method for reducing cyclic print errors. Applicants discovered that the cause of certain cyclic print errors was inconsistent (i.e., unequal) line spacing on the linear encoder strip used by the printer to track the position of the print head. Such inconsistent line spacing was caused by the inability of the device which makes/prints linear encoder strips to consistently match the ideal consistent line spacing desired and expected by the printer. Applicants found that such cyclic print errors were eliminated by choosing, obtaining, and installing a linear encoder strip having a consistent line spacing within the resolution capabilities of the device and, in one example, closest to the ideal consistent line spacing.

14 Claims, 2 Drawing Sheets

METHOD FOR REDUCING CYCLIC PRINT ERRORS

TECHNICAL FIELD

The present invention relates generally to printers, and more particularly to a method for reducing cyclic print errors in a printer.

BACKGROUND OF THE INVENTION

Printers include those printers having a print head whose position is determined from its motion across a linear encoder strip. The linear encoder strip has spaced-apart parallel lines (also called bars) and is installed in the printer by being mounted to the body of the printer. Typically, the manufacturer of linear encoder strips uses a laser plotter to make the lines on the linear encoder strip. The print head typically has an LED (light emitting diode)/photodetector mounted on the print head and straddling the linear encoder strip. As the print head moves across the linear encoder strip, light pulses are counted each time the print head moves from over a line on the linear encoder strip (such line blocking the light from the LED from reaching the photodetector) to over a transparent space between the lines on the linear encoder strip (such transparent space permitting the light from the LED to reach the photodetector). The pulse count is used to determine the position of the print head, and the pulse count rate may be used to also determine the velocity of the print head. The position (and velocity, if required) of the print head is used by the printer in deciding when to print and when not to print.

Examination of printed pages from printers sometimes show print errors. Examination of printed pages from printers having a print head whose position is determined from its motion across a linear encoder strip have shown cyclic print errors. Cyclic print errors include a compressed or expanded print space or print image which alone would be practically unnoticeable by a viewer. However, because of the cyclic occurrence of this print error, a pattern of compressed and/or expanded print spaces and/or print images is created. Such pattern, referred to as a cyclic print error, is very noticeable by the viewer. The cause or causes of such cyclic print errors from such printers and a way to reduce such errors have been unknown.

What is needed is a method for reducing cyclic print errors in a printer, wherein the printer has a print head whose position is determined from its motion across a linear encoder strip.

SUMMARY OF THE INVENTION

A first method of the invention is for reducing cyclic print errors in a printer and includes several steps. Step a) includes determining at least one possible consistent line spacing for linear encoder strips. Step b) includes choosing a line spacing from the at least one possible consistent line spacing. Step c) includes obtaining a linear encoder strip having the chosen line spacing. Step d) includes installing the linear encoder strip in the printer.

A second method of the invention is for reducing cyclic print errors in a printer and incudes several steps. Step a) includes determining at least one possible consistent line width for linear encoder strips. Step b) includes choosing a line width from the at least one possible consistent line width. Step c) includes obtaining a linear encoder strip having the chosen line width. Step d) includes installing the linear encoder strip in the printer.

A third method of the invention is for reducing cyclic print errors in a printer and includes several steps. Step a) includes determining at least one possible consistent and equal line spacing and width for linear encoder strips. Step b) includes choosing an equal line spacing and width from the at least one possible consistent and equal line spacing and width. Step c) includes obtaining a linear encoder strip having the chosen equal line spacing and width. Step d) includes installing the linear encoder strip in the printer.

A fourth method of the invention is for reducing cyclic print errors in a printer and includes several steps. Step a) includes choosing an optimal equal line spacing and width from the equation: $X_{optimal}$=round(R*$X_{ideal}$)/R, wherein $X_{optimal}$ is the optimal equal line spacing and width, wherein "round" is the mathematical rounding function which rounds a number to the nearest integer using standard mathematical rules for rounding numbers, wherein R is the inverse of the resolution capability of a device which makes/prints linear encoder strips having consistent and equal line spacing and width of the lines on the linear encoder strip, wherein $X_{ideal}$ is the ideal consistent and equal line spacing and width, and wherein "*" denotes multiplication and "/" denotes division. Step b) includes obtaining a linear encoder strip having the chosen equal line spacing and width. Step c) includes installing the linear encoder strip in the printer.

Several benefits and advantages are derived from the invention. Applicants discovered that a major source of cyclic print errors was inconsistent line spacing and width of the lines on the linear encoder strip used by the printer to determine the position of the print head. Applicants had ordered from the encoder-strip manufacturer a particular consistent and equal line spacing and width for the linear encoder strip which was the ideal consistent and equal line spacing and width for which Applicants' printer was designed. Although Applicants had specified a particular and equal line spacing and width, Applicants discovered that the manufacturer of linear encoder strips provided strips with inconsistent line spacing and width. Applicants discovered that the encoder-strip manufacturer used a laser plotter to make the lines on the linear encoder strip and that the resolution capability of the plotter was such that it could not match the particular and equal line spacing and width ordered by Applicants. When the plotter of the encoder-strip manufacturer tried to create the particular and equal line spacing and width ordered by Applicants, the plotter performed a rounding-off operation causing round-off errors which led to a cyclic pattern of inconsistent line spacing and width which caused cyclic print errors when the linear encoder strips were used in Applicants' printer. Instead of telling the encoder-strip manufacturer to make a linear encoder strip with a particular and equal line spacing and width, the methods of Applicants' invention choose one of the possible consistent line spacing and/or width of the lines on the linear encoder strip that the manufacture is able to supply. In one example, the chosen line spacing and/or width is the possible consistent line spacing and/or width close or closest to the ideal consistent line spacing and/or width. Applicants found that its printers would operate successfully with the chosen consistent and equal line spacing and width which eliminated the previously-described cyclic print errors. Applicants believe the previously-described cyclic print errors would be reduced if either the line spacing or the line width were consistent. It is noted that a page printed by a printer using Applicants' invention will have a slightly reduced or enlarged print area. However, the slightly reduced or enlarged print area is not objectionable to a viewer of the printed page compared to those objectionable cyclic print areas which are present in the prior art and which are eliminated by use of Applicants' invention.

DETAILED DESCRIPTION

A first method of the invention is for reducing cyclic print errors in a printer. The printer has a print head whose position is determined from its motion across a linear encoder strip having spaced-apart parallel lines. The printer is designed for an ideal consistent line spacing of the lines on the linear encoder strip. However, a manufacturer of linear encoder strips is unable to supply a linear encoder strip having the ideal consistent line spacing. The first method includes steps a) through d) and is outlined in even-numbered blocks 10–16 of FIG. 1.

Figure 1:
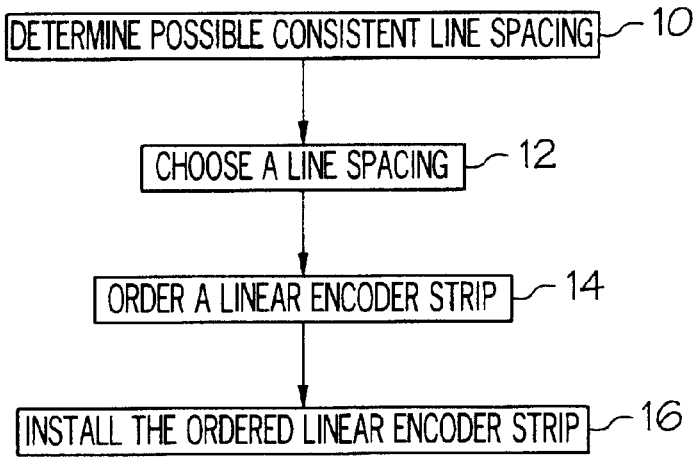
FIG. 1 is a block-diagram flow chart of a first method of the invention.

Step a) is shown in block 10 of FIG. 1 as "Determine Possible Consistent Line Spacing". Step a) includes determining at least one possible consistent line spacing for linear encoder strips capable of being supplied by the encoder-strip manufacturer. By consistent line spacing is meant an equal spacing (i.e., an equal line-to-line distance) between adjacent lines on the linear encoder strip. In one implementation of step a), the encoder-strip manufacturer is asked to supply a partial or complete list of possible consistent line spacings. In another implementation of step a), the resolution capability for line spacing for the lines on the linear encoder strip is obtained from the encoder-strip manufacturer (or otherwise obtained knowing the equipment used by the encoder-strip manufacturer in producing the line spacing). In this other implementation of step a), possible consistent line spacings are integer multiples of the resolution capability. For example, a resolution capability of $1/8000$ of an inch means possible line spacings include $1/8000$ of an inch, $2/8000$ of an inch, $3/8000$ of an inch, et. seq. It is noted that when the lines on the linear encoder strip are made by the encoder-strip manufacturer using a plotter, the resolution capability for line spacing is the resolution capability of the plotter. As an example, an 8000-dots-per-inch plotter has a resolution capability of $1/8000$ of an inch for line spacing (and $1/8000$ of an inch for line width), wherein it is noted that the value of the inverse of that resolution capability is 8000.

Step b) is shown in block 12 of FIG. 1 as "Choose A Line Spacing". Step b) includes choosing a line spacing from the at least one possible consistent line spacing determined in step a). In one example, a line spacing is chosen, from the at-least-one possible consistent line spacing, which is close enough to the ideal consistent line spacing for which the printer is designed, so that the overall print image area on a page using the chosen consistent line spacing is within ten percent of the vertical size and within ten percent of the horizontal size of the overall print image area on a page using an ideal consistent line spacing, assuming such ideal consistent line spacing were available (which, in the invention, it is not). The closer one chooses, the closer in size will be the overall print image area to the ideal. In another example, step a) includes determining ten possible consistent line spacings for linear encoder strips capable of being supplied by the encoder-strip manufacturer which are closest to the ideal consistent line spacing, and step b) includes choosing a line spacing from the ten closest possible consistent line spacings to the ideal consistent line spacing. In a further example, step a) includes determining a possible consistent line spacing for linear encoder strips capable of being supplied by the encoder-strip manufacturer which is closest to the ideal consistent line spacing, and step b) includes choosing a line spacing equal to the possible consistent line spacing closest to the ideal consistent line spacing. It is noted that it is conceivable to have two possible consistent line spacings identically closest to the ideal consistent line spacing, and in this case, one of these two is chosen as the closest possible consistent line spacing for purposes of this exemplary step a). In a further example, when possible, the chosen line spacing is also an integer multiple of the ideal line spacing. This allows the use of a less-expensive, low-resolution plotter to make/print the linear encoder strip.

Step c) is shown in block 14 of FIG. 1 as "Obtain A Linear Encoder Strip". Step c) includes obtaining a linear encoder strip having the chosen line spacing of step b). It bears repeating that while not ideal, the chosen line spacing is within the resolution capability of the device which makes/prints the linear encoder strip.

Step d) is shown in block 16 of FIG. 1 as "Install The Linear Encoder Strip". Step d) includes installing the linear encoder strip in the printer. In an example, the first method also includes, after step d), the step of operating the printer.

A second method of the invention is for reducing cyclic print errors in a printer. The printer has a print head whose position is determined from its motion across a linear encoder strip having spaced-apart parallel lines. The printer is designed for an ideal consistent line width of the lines on the linear encoder strip. However, a manufacturer of linear encoder strips is unable to supply a linear encoder strip having the ideal consistent line width. The second method includes steps a) through d) and is outlined in even-numbered blocks 18–24 of FIG. 2.

Figure 2:
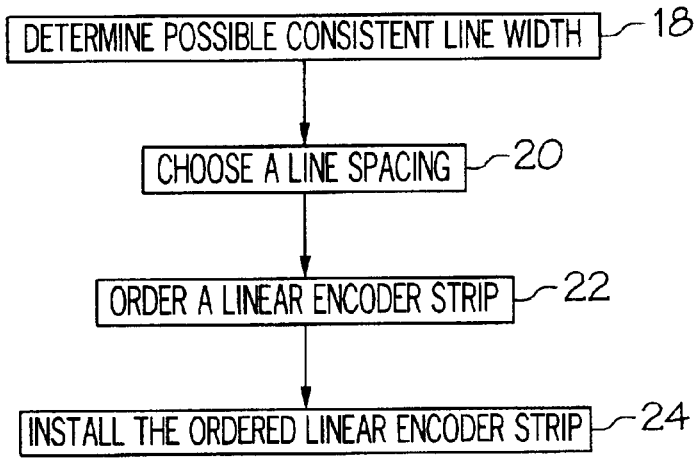
FIG. 2 is a block-diagram flow chart of a second method of the invention.

Step a) is shown in block 18 of FIG. 2 as "Determine Possible Consistent Line Width". Step a) includes determining at least one possible consistent line width for linear encoder strips capable of being supplied by the encoder-strip manufacturer. By consistent line width is meant an equal width for each line on the linear encoder strip used in determining the position of the print head (except possibly the first and last lines). In one implementation of step a), the encoder-strip manufacturer is asked to supply a partial or complete list of possible consistent line widths. In another implementation of step a), the resolution capability for line width for the lines on the linear encoder strip is obtained from the encoder-strip manufacturer (or otherwise obtained knowing the equipment used by the encoder-strip manufacturer in producing the line width). In this other implementation of step a), possible consistent line widths are integer multiples of the resolution capability. For example, a resolution capability of $1/8000$ of an inch means possible line widths include $1/8000$ of an inch, $2/8000$ of an inch, $3/8000$ of an inch, et. seq. It is noted that when the lines on the linear encoder strip are made by the encoder-strip manufacturer using a plotter, the resolution capability for line width is the resolution capability of the plotter. As an example, an 8000-dots-per-inch plotter has a resolution capability of $1/8000$ of an inch for line width (and $1/8000$ of an inch for line spacing), wherein it is noted that the value of the inverse of that resolution capability is 8000.

Step b) is shown in block 20 of FIG. 2 as "Choose A Line Width". Step b) includes choosing a line width from the at-least-one possible consistent line width determined in step a). In one example, a line width is chosen, from the at least one possible consistent line width, which is close enough to the ideal consistent line width for which the printer is designed, so that the overall print image area on a page using the chosen consistent line width is within ten percent of the vertical size and within ten percent of the horizontal size of the overall print image area on a page using an ideal consistent line width, assuming such ideal consistent line width were available (which, in the invention, it is not). The closer one chooses, the closer in size will be the overall print image area to the ideal. In another example, step a) includes determining ten possible consistent line widths for linear encoder strips capable of being supplied by the encoder-strip manufacturer which are closest to the ideal consistent line width, and step b) includes choosing a line width from the ten closest possible consistent line widths to the ideal consistent line width. In a further example, step a) includes determining a possible consistent line width for linear encoder strips capable of being supplied by the encoder-strip manufacturer which is closest to the ideal consistent line width, and step b) includes choosing a line width equal to the possible consistent line width closest to the ideal consistent line width. It is noted that it is conceivable to have two possible consistent line widths identically closest to the ideal consistent line width, and in this case, one of these two is chosen as the closest possible consistent line spacing for purposes of this exemplary step a). In a further example, when possible, the chosen line width is also an integer multiple of the ideal line width. This allows the use of a less-expensive, low-resolution plotter to make/print the linear encoder strip.

Step c) is shown in block 22 of FIG. 2 as "Obtain A Linear Encoder Strip". Step c) includes obtaining a linear encoder strip having the chosen line width of step b). It bears repeating that while not ideal, the chosen line width is within the resolution capability of the device which makes/prints the linear encoder strip.

Step d) is shown in block 24 of FIG. 2 as "Install The Linear Encoder Strip". Step d) includes installing the linear encoder strip in the printer. In an example, the second method also includes, after step d), the step of operating the printer.

Figure 3:
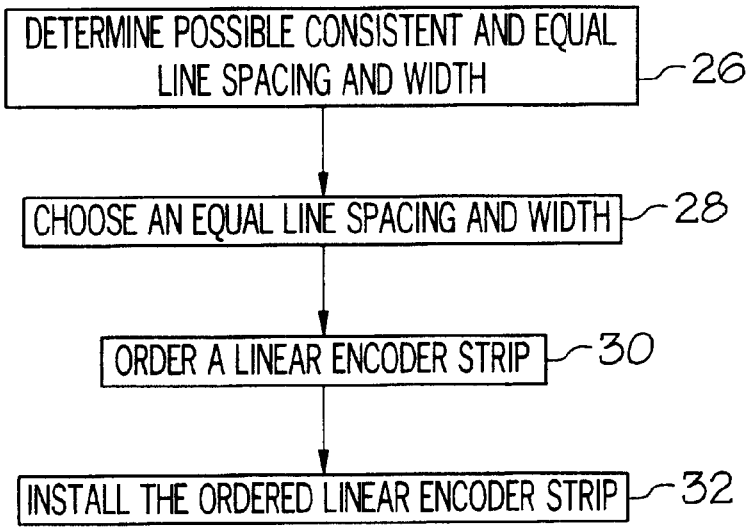
FIG. 3 is a block-diagram flow chart of a third method of the invention.

A third method of the invention is for reducing cyclic print errors in a printer and is outlined in even-numbered blocks 26–32 of FIG. 3. The third method combines the previously-described first and second methods and also requires the line spacing to equal the line width. A detailed description of the third method is achieved by appropriately adding "and width" after "line spacing" and by appropriately adding "and equal" after "consistent" in the previously-given description of the first method. It is also noted that in the third method, one chooses an equal line spacing and width in step b) instead of choosing a line spacing as in step b) of the first method. Thus, in the third method, the printer is designed for an ideal consistent and equal line spacing and width, step a) determines at least one possible consistent and equal line spacing and width, and step b) chooses an equal line spacing and width from the at-least-one possible consistent and equal line spacing and width. It is noted that "consistent and equal line spacing and width" means an equal spacing (i.e., an equal line-to-line distance) between adjacent lines on the linear encoder strip AND an equal width for each line on the linear encoder strip used in determining the position of the print head (except possibly the first and last lines) AND the line spacing equals the line width.

A fourth method of the invention is for reducing cyclic print errors in a printer. The printer has a print head whose position is determined from its motion across a linear encoder strip having spaced-apart parallel lines. The printer is designed for an ideal consistent and equal line spacing and width of the lines on the linear encoder strip. By "consistent and equal line spacing and width" is meant an equal spacing (i.e., an equal line-to-line distance) between adjacent lines on the linear encoder strip AND an equal width for each line on the linear encoder strip used in determining the position of the print head (except possibly the first and last lines) AND the line spacing equals the line width. A manufacturer of linear encoder strips is able to supply a linear encoder strip having consistent and equal line spacing and width with a resolution capability, or integer multiple thereof, unequal to the ideal consistent and equal line spacing and width. Typically, the lines on the linear encoder strip are made by the encoder-strip manufacturer using a plotter, and the resolution capability for line width is the resolution capability of the plotter. Typically the plotter is said to able to print a particular number R of dots per unit of linear measurement, wherein the resolution capability is 1/R of the unit of linear measurement, and wherein the value of the inverse of the resolution capability is R. As an example, an 8000-dots-per-inch plotter has a resolution capability of 1/8000 of an inch for line width and 1/8000 of an inch for line spacing, and the value of the inverse of that resolution capability is 8000. The fourth method includes steps a) through c), and is outlined in even-numbered blocks 34–38 of FIG. 4.

Figure 4:
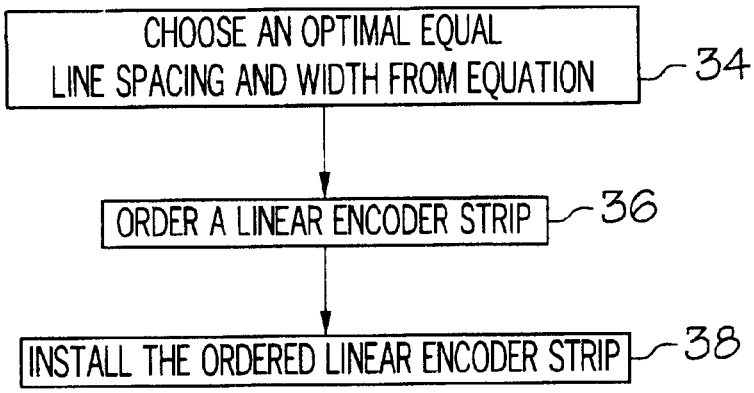
FIG. 4 is a block-diagram flow chart of a fourth method of the invention.

Step a) is shown in block 34 of FIG. 4 as "Choose An Optimal Equal Line Spacing And Width From Equation". Step a) includes choosing an optimal equal line spacing and width from the following equation:

$$X_{optimal}=\text{round}(R*X_{ideal})/R,$$

wherein $X_{optimal}$ is the optimal equal line spacing and width, wherein "round" is the mathematical rounding function which rounds a number to the nearest integer using standard mathematical rules for rounding numbers, wherein R is the value of the inverse of the resolution capability of a device which makes/prints linear encoder strips having consistent and equal line spacing and width of the lines on the linear encoder strip, wherein $X_{ideal}$ is the ideal consistent and equal line spacing and width, and wherein "*" denotes multiplication and "/" denotes division.

Step b) is shown in block 36 of FIG. 4 as "Obtain A Linear Encoder Strip". Step b) includes obtaining a linear encoder strip having the chosen line spacing and width of step a). It bears repeating that while not ideal, the chosen line spacing and width is that closest to the resolution capability of the device which makes/prints the linear encoder strip.

Step c) is shown in block 38 of FIG. 4 as "Install The Linear Encoder Strip". Step c) includes installing the linear encoder strip in the printer. In an example, the fourth method also includes, after step c), the step of operating the printer.

Several benefits and advantages are derived from the invention. Applicants discovered that a major source of cyclic print errors was inconsistent line spacing and width of the lines on the linear encoder strip used by the printer to determine the position of the print head. Applicants had ordered from the encoder-strip manufacturer a particular consistent and equal line spacing and width for the linear encoder strip which was the ideal consistent and equal line spacing and width for which Applicants' printer was designed. Although Applicants had specified a particular and equal line spacing and width, Applicants discovered that the manufacturer of linear encoder strips provided strips with inconsistent line spacing and width. Applicants discovered that the encoder-strip manufacturer used a plotter to make the lines on the linear encoder strip and that the resolution capability of the plotter was such that it could not match the particular and equal line spacing and width ordered by Applicants. When the plotter of the encoder-strip manufacturer tried to create the particular and equal line spacing and width ordered by Applicants, the plotter performed a rounding-off operation causing round-off errors which led to a cyclic pattern of inconsistent line spacing and width which caused cyclic print errors when the linear encoder strips were used in Applicants' printer. Instead of telling the encoder-strip manufacturer to make a linear encoder strip with a particular and equal line spacing and width, the methods of Applicants' invention choose one of the possible consistent line spacing and/or width of the lines on the linear encoder strip that the manufacture is able to supply. In one example, the chosen line spacing and/or width is the possible consistent line spacing and/or width close or closest to the ideal consistent line spacing and/or width. Applicants found that its printers would operate successfully with the chosen consistent and equal line spacing and width which eliminated the previously-described cyclic print errors. Applicants believe the previously-described cyclic print errors would be reduced if either the line spacing or the line width were consistent. It is noted that a page printed by a printer using Applicants' invention will have a slightly reduced or enlarged print area. However, the slightly reduced or enlarged print area is not objectionable to a viewer of the printed page compared to those objectionable cyclic print areas which are present in the prior art and which are eliminated by use of Applicants' invention.

The foregoing description of several methods of the invention has been presented for purposes of illustration. It is not intended to be exhaustive or to limit the invention to the precise methods disclosed, and obviously many modifications and variations are possible in light of the above teaching. It is intended that the scope of the invention be defined by the claims appended hereto.

What is claimed is:

1. A method for reducing cyclic print errors in a printer comprising the steps of:

a) determining at least one possible consistent line spacing for linear encoder strips;

b) choosing a line spacing from the at least one possible consistent line spacing;

c) obtaining a linear encoder strip having the chosen line spacing; and d) installing the linear encoder strip in the printer.

2. The method of claim 1, further comprising the step of operating the printer.

3. The method of claim 1, wherein said determining step determines possible consistent line spacings for linear encoder strips which are closest to an ideal consistent line spacing, and wherein said choosing step chooses a line spacing from the possible consistent line spacings closest to the ideal consistent line spacing.

4. The method of claim 1, wherein said choosing step chooses a line spacing from the possible consistent line spacings which is an integer multiple of an ideal consistent line spacing.

5. A method for reducing cyclic print errors in a printer comprising the steps of:

a) determining at least one possible consistent line width for linear encoder strips;

b) choosing a line width from the at least one possible consistent line width;

c) obtaining a linear encoder strip having the chosen line width; and d) installing the linear encoder strip in the printer.

6. The method of claim 5, further comprising the step of operating the printer.

7. The method of claim 5, wherein said determining step determines possible consistent line widths for linear encoder strips which are closest to an ideal consistent line width, and wherein said choosing step chooses a line width from the possible consistent line widths closest to the ideal consistent line width.

8. The method of claim 5, wherein said choosing step chooses a line width from the possible consistent line widths which is an integer multiple of an ideal consistent line width.

9. A method for reducing cyclic print errors in a printer comprising the steps of:

a) determining at least one possible consistent and equal line spacing and width for linear encoder strips;

b) choosing an equal line spacing and width from the at least one possible consistent and equal line spacing and width;

c) obtaining a linear encoder strip having the chosen equal line spacing and width; and d) installing the linear encoder strip in the printer.

10. The method of claim 9, further comprising the step of operating the printer.

11. The method of claim 9, wherein said determining step determines possible consistent and equal line spacings and widths for linear encoder strips which are closest to an ideal consistent and equal line spacing and width, and wherein said choosing step chooses an equal line spacing and width from the possible consistent and equal line spacings and widths closest to the ideal consistent and equal line spacing and width.

12. The method of claim 9, wherein said choosing step chooses an equal line spacing and width from the possible consistent and equal line spacings and widths which is an integer multiple of an ideal consistent and equal line spacing and width.

13. A method for reducing cyclic print errors in a printer comprising the steps of:

a) choosing an optimal equal line spacing and width from the following equation:

$$X_{optimal}=\text{round}(R*X_{ideal})/R,$$

wherein $X_{optimal}$ is the optimal equal line spacing and width, wherein "round" is the mathematical rounding function which rounds a number to the nearest integer using standard mathematical rules for rounding numbers, wherein R is the value of the inverse of the resolution capability of a device which makes/prints linear encoder strips having consistent and equal line spacing and width of the lines on the linear encoder strip, and wherein $X_{ideal}$ is the ideal consistent and equal line spacing and width;

b) obtaining a linear encoder strip having the chosen equal line spacing and width; and c) installing the linear encoder strip in the printer.

14. The method of claim 13, further comprising the step of operating the printer.

* * * * *